US008490785B2

(12) United States Patent
Brand

(10) Patent No.: US 8,490,785 B2
(45) Date of Patent: Jul. 23, 2013

(54) CARRIER FOR CONTAINERS

(75) Inventor: Kirsten L. Brand, Marietta, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 815 days.

(21) Appl. No.: 12/639,240

(22) Filed: Dec. 16, 2009

(65) Prior Publication Data

US 2010/0147932 A1 Jun. 17, 2010

Related U.S. Application Data

(60) Provisional application No. 61/201,898, filed on Dec. 16, 2008.

(51) Int. Cl.
*B65D 75/00* (2006.01)

(52) U.S. Cl.
USPC ..... 206/199; 206/162; 206/164; 206/191; 229/117.01

(58) Field of Classification Search
USPC ..... 229/117.01, 117.14; 493/128; 206/164, 206/162, 187, 176, 191, 173, 199, 151, 152, 206/153, 154, 155, 156, 157, 158
See application file for complete search history.

(56) References Cited

U.S. PATENT DOCUMENTS

| | | | | |
|---|---|---|---|---|
| 2,225,822 | A | | 12/1940 | Crook |
| 2,227,330 | A | | 12/1940 | Turner |
| 2,331,312 | A | | 10/1943 | Dorfman |
| 2,336,857 | A | | 12/1943 | Gies et al. |
| 2,460,108 | A | | 1/1949 | Smith et al. |
| 2,689,061 | A | | 9/1954 | Gray |
| 2,721,001 | A | | 10/1955 | Hasselhoff |
| 2,776,072 | A | | 1/1957 | Forrer |
| 2,783,916 | A | * | 3/1957 | Hodapp ..... 206/167 |
| 3,029,977 | A | | 4/1962 | Arneson |
| 3,053,411 | A | | 9/1962 | Struble et al. |
| 3,128,906 | A | | 4/1964 | Forrer |
| 3,190,487 | A | | 6/1965 | Wood |
| 3,191,800 | A | | 6/1965 | Kowal |
| 3,194,478 | A | | 7/1965 | Weiss |

(Continued)

FOREIGN PATENT DOCUMENTS

| | | |
|---|---|---|
| DE | 9004439 U1 | 6/1990 |
| EP | 1 319 607 A1 | 6/2003 |

(Continued)

OTHER PUBLICATIONS

International Search Report and Written Opinion for PCT/US2010/039607, dated Mar. 2, 2011.

(Continued)

*Primary Examiner* — J. Gregory Pickett
*Assistant Examiner* — Raven Collins
(74) *Attorney, Agent, or Firm* — Womble Carlyle Sandridge & Rice, LLP

(57) ABSTRACT

A carrier for containing a plurality of articles. The carrier comprises a plurality of panels that extend at least partially around the interior of the carrier. The panels comprise a front panel, a back panel positioned opposite to the front panel, at least one side panel foldably connected to at least one of the front and back panels, at least one top panel foldably connected to one of the front panel and the back panel, and a divider flap foldably connected to the at least one side panel.

37 Claims, 9 Drawing Sheets

U.S. PATENT DOCUMENTS 3,229,849 A 1/1966 Spillson
3,236,414 A 2/1966 Slevin, Jr.
3,313,466 A 4/1967 Keith
3,343,742 A 9/1967 Siegler
3,351,230 A 11/1967 Schuster
3,432,073 A 3/1969 Forrer
3,554,401 A 1/1971 Wood
3,624,790 A 11/1971 Stout
3,661,297 A 5/1972 Wood
3,669,306 A 6/1972 Forrer
3,672,539 A 6/1972 Forrer
3,721,335 A 3/1973 Grant
3,754,680 A 8/1973 Wood
3,784,053 A 1/1974 Stout
3,860,113 A 1/1975 Helms
3,917,059 A 11/1975 Wood
3,917,060 A 11/1975 Wood
3,917,061 A 11/1975 Stout
4,000,813 A 1/1977 Stout
4,010,847 A 3/1977 Wood et al.
4,153,158 A 5/1979 Graser et al.
4,171,046 A 10/1979 Bonczyk
4,205,748 A 6/1980 Wilson
4,217,983 A 8/1980 Stout
4,243,138 A 1/1981 Wilson
4,250,992 A 2/1981 Gilbert
4,253,564 A 3/1981 Engdahl, Jr.
4,308,950 A 1/1982 Wood
4,319,682 A 3/1982 Wright et al.
4,362,240 A 12/1982 Edward
4,374,561 A 2/1983 Stout et al.
4,406,365 A 9/1983 Kulig
4,413,729 A 11/1983 Wood
4,450,956 A 5/1984 Wood
4,480,746 A 11/1984 Wood
4,544,092 A 10/1985 Palmer
4,591,090 A 5/1986 Collins et al.
4,722,437 A 2/1988 Walsh
4,770,294 A 9/1988 Graser
4,792,038 A 12/1988 Cooper
4,798,285 A 1/1989 Hernandez
4,901,849 A 2/1990 Wilson
4,927,009 A 5/1990 Stout
5,029,698 A 7/1991 Stout
5,040,672 A 8/1991 DeMaio et al.
5,072,876 A 12/1991 Wilson
5,123,588 A 6/1992 Harris
5,191,976 A 3/1993 Stout et al.
5,234,103 A 8/1993 Schuster
5,246,113 A 9/1993 Schuster
5,282,348 A 2/1994 Dampier et al.
5,359,830 A 11/1994 Olson et al.
5,360,104 A 11/1994 Sutherland
5,363,954 A 11/1994 Dampier et al.
5,400,901 A 3/1995 Harrelson
5,458,234 A 10/1995 Harris
5,482,203 A 1/1996 Stout
5,484,053 A 1/1996 Harris
5,499,712 A 3/1996 Harrelson
5,518,110 A 5/1996 Harrelson
5,531,319 A 7/1996 Harrelson
5,538,130 A 7/1996 Harrelson
5,538,131 A 7/1996 Harrelson
5,579,625 A 12/1996 Olson et al.
5,590,762 A 1/1997 Harrelson
5,593,027 A 1/1997 Sutherland
5,620,094 A 4/1997 Naumann
5,638,956 A 6/1997 Sutherland
5,645,162 A 7/1997 Harrelson
5,649,620 A 7/1997 Harrelson
5,657,864 A 8/1997 Harrelson
5,657,865 A 8/1997 Harrelson
5,680,930 A 10/1997 Stone
5,682,982 A 11/1997 Stonehouse
5,695,051 A 12/1997 Hart
5,765,685 A 6/1998 Roosa
5,775,487 A 7/1998 Harrelson
5,819,920 A 10/1998 Sutherland
5,855,316 A 1/1999 Spivey
5,871,090 A 2/1999 Doucette et al.
5,878,877 A 3/1999 Sutherland
5,884,756 A 3/1999 Holley, Jr. et al.
5,947,273 A 9/1999 Dalrymple et al.
6,041,920 A 3/2000 Hart et al.
6,112,977 A 9/2000 Sutherland et al.
6,131,729 A 10/2000 Eckermann et al.
6,155,962 A 12/2000 Dalrymple et al.
6,168,013 B1 1/2001 Gomes
6,230,881 B1 5/2001 Collura
6,247,585 B1 * 6/2001 Holley, Jr. ..... 206/173
6,315,111 B1 11/2001 Sutherland
6,341,689 B1 1/2002 Jones
6,371,287 B1 4/2002 Jones et al.
6,695,137 B2 2/2004 Jones et al.
6,736,260 B2 5/2004 Gomes et al.
6,802,802 B2 10/2004 Woog
6,814,228 B2 11/2004 Sutherland
6,938,756 B2 9/2005 Schuster
7,011,209 B2 * 3/2006 Sutherland et al. ..... 206/175
7,025,197 B2 4/2006 Sutherland
7,070,045 B2 7/2006 Theelen
7,128,206 B2 10/2006 Kohler
7,134,547 B2 * 11/2006 Auclair ..... 206/143
7,207,934 B2 4/2007 Schuster
7,374,038 B2 5/2008 Smalley
7,448,492 B2 11/2008 Sutherland
7,472,791 B2 1/2009 Spivey, Sr.
7,552,820 B2 6/2009 Kohler
7,604,116 B2 10/2009 Schuster
7,644,817 B2 1/2010 Sutherland
7,677,387 B2 3/2010 Brand et al.
7,762,395 B2 7/2010 Sutherland et al.
7,762,397 B2 7/2010 Coltri-Johnson et al.
7,793,780 B2 * 9/2010 Smalley ..... 206/164
2002/0077236 A1 6/2002 Chalendar et al.
2002/0117407 A1 8/2002 Holley
2003/0159950 A1 8/2003 Jones et al.
2004/0050722 A1 3/2004 Schuster
2004/0094435 A1 5/2004 Auclair et al.
2005/0211577 A1 9/2005 Bakx
2005/0218014 A1 10/2005 Schuster
2005/0230273 A1 10/2005 Kohler
2006/0148629 A1 7/2006 Cuomo
2006/0157545 A1 7/2006 Auclair
2007/0151873 A1 7/2007 Schuster
2008/0210581 A1 9/2008 Brand
2010/0006458 A1 1/2010 Wilkins et al.

FOREIGN PATENT DOCUMENTS

WO 9306825 U1 7/1993
WO 9509780 A1 4/1995
WO WO 97/05026 2/1997

OTHER PUBLICATIONS

International Search Report of related PCT Application No. PCT/US2009/068176, mailed Aug. 2, 2010.
Written Opinion of related PCT Application No. PCT/US2009/068176, mailed Aug. 2, 2010.
Supplementary European Search Report for EP 09 83 6865 dated Apr. 3, 2012.

* cited by examiner

CARRIER FOR CONTAINERS

CROSS-REFERENCE TO RELATED APPLICATIONS

This application claims the benefit of U.S. Provisional Patent Application No. 61/201,898, filed Dec. 16, 2008.

INCORPORATION BY REFERENCE

U.S. Provisional Application No. 61/201,898, which was filed on Dec. 16, 2008, is hereby incorporated by reference for all purposes as if presented herein in its entirety.

BACKGROUND OF THE DISCLOSURE

The present disclosure generally relates to carriers or cartons for holding and displaying containers. More specifically, the present disclosure relates to basket-style carriers.

SUMMARY OF THE DISCLOSURE

In general, one aspect of the disclosure is directed to a carrier for holding a plurality of containers. The carrier comprises a plurality of panels that extend at least partially around the interior of the carrier. The panels comprise a front panel, a back panel positioned opposite to the front panel, at least one side panel foldably connected to at least one of the front and back panels, at least one top panel foldably connected to one of the front panel and the back panel, and a divider flap foldably connected to the at least one side panel.

In general, another aspect of the disclosure is directed to a blank for forming a carrier package. The blank comprises a front panel, a back panel, at least one side panel foldably connected to at least one of the front and back panels, at least one top panel foldably connected to one of the front panel and the back panel, and a divider flap foldably connected to the at least one side panel.

In general, another aspect of the disclosure is directed to a method of assembling a carrier. The method comprises obtaining a blank comprising a front panel, a back panel, at least one side panel foldably connected to at least one of the front and back panels, at least one top panel foldably connected to one of the front panel and the back panel, and a divider flap foldably connected to the at least one side panel. The method further comprises positioning the front panel, the back panel, and the at least one side panel to form an interior of the carrier, the forming the interior of the carrier comprising forming a sleeve having at least one open end. The method further comprises positioning the divider flap to at least partially divide the interior of the carrier.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENT

The present disclosure generally relates to carriers, packages, constructs, sleeves, cartons, or the like, for holding and displaying containers such as jars, bottles, cans, etc. The containers can be used for packaging food and beverage products, for example. The containers can be made from materials suitable in composition for packaging the particular food or beverage item, and the materials include, but are not limited to, plastics such as PET, LDPE, LLDPE, HDPE, PP, PS, PVC, EVOH, and Nylon; and the like; aluminum and/or other metals; glass; any combination thereof, or any other suitable material.

Carriers according to the present disclosure can accommodate containers of numerous different shapes. For the purpose of illustration and not for the purpose of limiting the scope of the disclosure, the following detailed description describes beverage containers (e.g., plastic containers) at least partially disposed within the carrier embodiments. In this specification, the terms "lower," "bottom," "upper", "top", "front", and "back" indicate orientations determined in relation to fully erected carriers.

Figure 1:
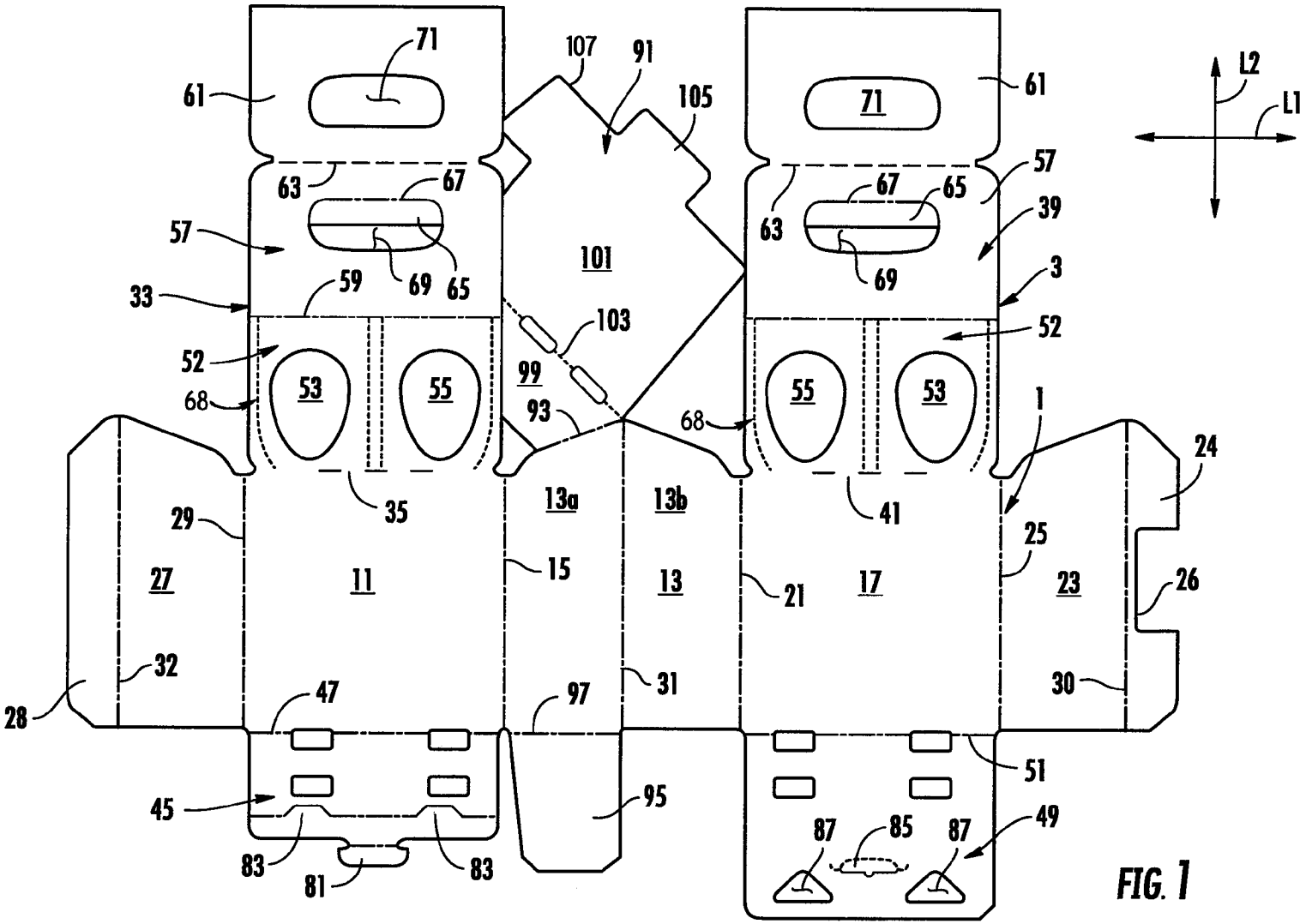
FIGS. 1 and 2 are plan views of a blank used to form a carrier according to a first embodiment of the disclosure
Figure 2:
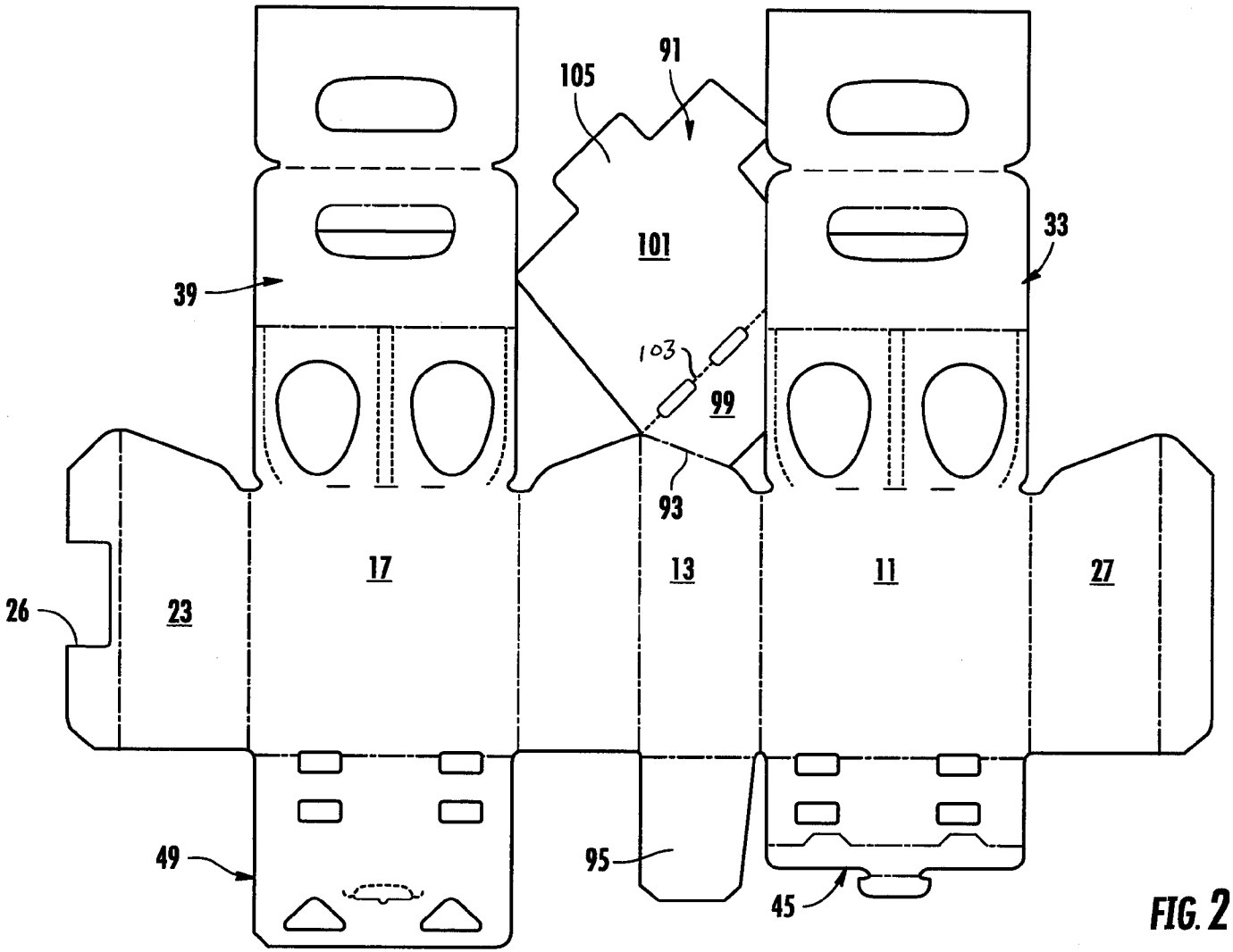

FIG. 1 is a plan view of an exterior side 1 of a blank 3 used to form a package or basket-style carrier 5 (FIGS. 8 and 9), in accordance with an exemplary embodiment of the present disclosure. The carrier 5 is sized to contain four containers C with upper portions P. The containers C can be generally cylindrical beverage containers having a cap or lid attached to an open top of the container C. The carrier 5 may be sized and shaped to hold more or less than four containers C. Also, the carrier 5 may hold containers C other than the generally cylindrical beverage containers illustrated in FIG. 9.

The blank 3 has a longitudinal axis L1 and a lateral axis L2. The blank 3 has a front panel 11 foldably connected to a first side panel 13 at a lateral fold line 15. A back panel 17 is foldably connected to the first side panel 13 at a lateral fold line 21. A second side panel 23 is foldably connected to the back panel 17 at a lateral fold line 25. A third side panel 27 is foldably connected to the front panel 11 at a lateral fold line 29. In the illustrated embodiment, the second and third side panels 23, 27 include respective adhesive flaps 24, 28 foldably connected to a respective side panel at a lateral fold line 30, 32. The adhesive flap 24 is foldably connected to the second side panel 23 and includes a notch 26 in a lateral edge of the blank 3. The first side panel 13 includes a front and a back portion 13*a*, 13*b* foldably connected at a lateral fold line 31.

In the illustrated embodiment, a first top panel 33 is foldably connected to the front panel 11 at a longitudinal fold line 35. A second top panel 39 is foldably connected to the back panel 17 at a longitudinal fold line 41. A first bottom panel 45 is foldably connected to the front panel 11 at a longitudinal fold line 47. A second bottom panel 49 is foldably connected to the back panel 17 at a longitudinal fold line 51.

Figure 8:
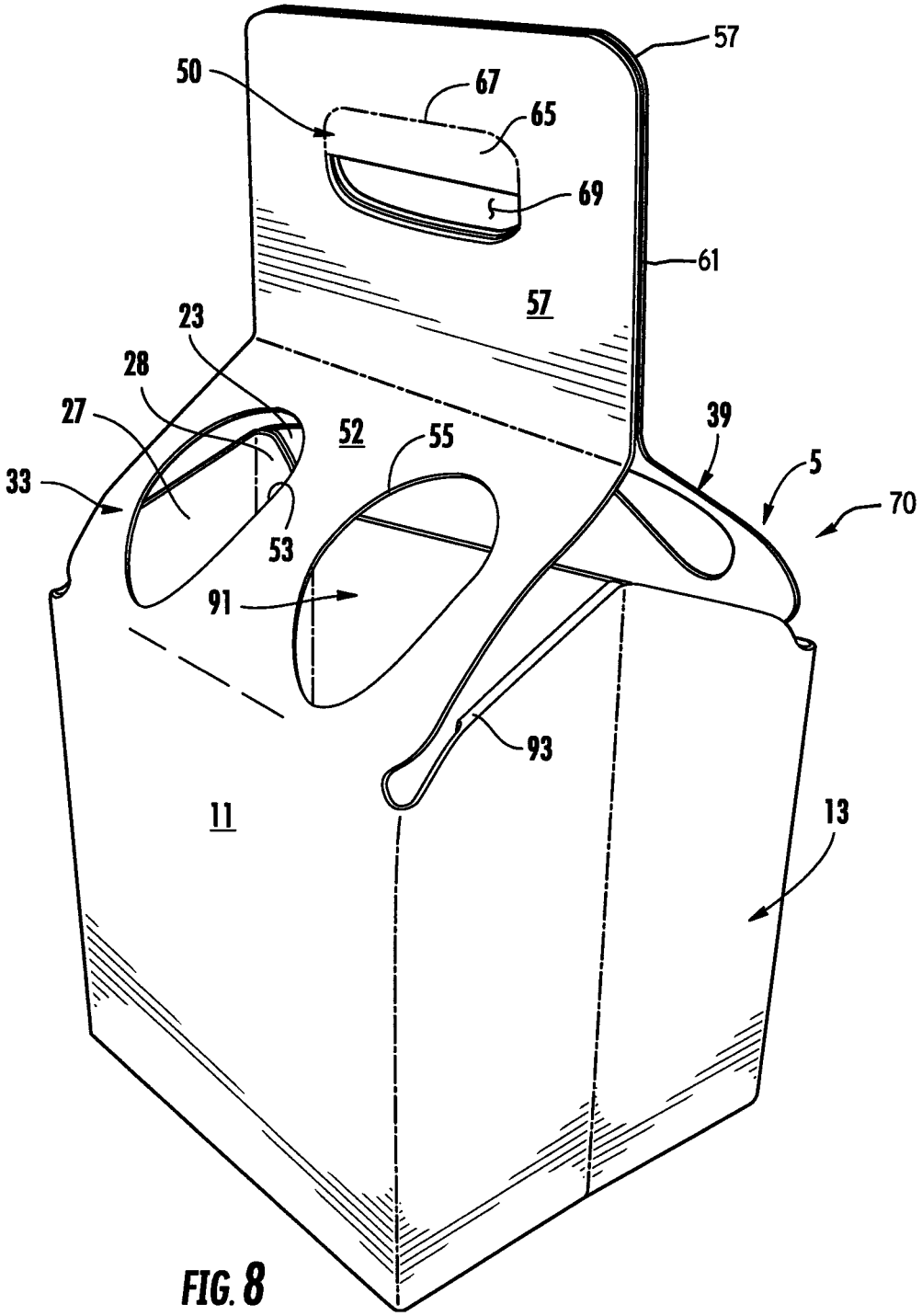
FIGS. 8 and 9 are perspective views of the erected carrier.

In one embodiment, the first and second top panels 33, 39 are generally mirror-images of each other and include features for forming a handle 50 of the carrier 5 (FIG. 8). Each of the top panels 33, 39 includes a lower portion 52 having two apertures 53, 55, a first handle portion 57 foldably connected to the lower portion at a longitudinal fold line 59, and a second handle portion 61 foldably connected to the first handle portion at a longitudinal fold line 63. Each lower portion 52 includes a plurality of generally lateral lower portion lines 68, such as score lines or fold lines, that facilitate bending or folding of the lower portion 52 while retaining the containers C, which can push up against the lower portions 52. The first handle portion 57 includes a handle flap 65 foldably connected to the blank 3 at a longitudinal fold line 67 and being adjacent a first handle opening 69. The second handle portion 61 forms a reinforcing top flap and includes a second handle opening 71. The blank 3 could include handle features that are otherwise shaped, arranged, and/or configured, or the handle features could be omitted.

In the illustrated embodiment, the first bottom panel 45 includes a male locking member 81 at a free edge of the first handle panel, and two male locking tabs 83 spaced inward from the male locking member. The second bottom panel 49 includes a female locking flap 85 and two female locking openings 87. The male locking member 81 and the female locking flap 85 are shaped for interlocking engagement when the first and second bottom panels 45, 49 are overlapped to form a bottom panel 86 (FIG. 7) of the carrier 5. The male locking tabs 83 are configured to engage the female locking openings 87 when the male locking member 81 and the female locking flap 85 are interlocked. The bottom panel 86 can be otherwise configured to at least partially close the bottom end 72 of the carrier.

As shown in FIG. 1, the blank 3 includes a divider flap 91 foldably connected to the front portion 13 a of the first side panel 13 at an oblique fold line 93 and a reinforcing flap 95 foldably connected to the front portion 13*a* of the first side panel at a longitudinal fold line 97. The divider flap 91 includes a first (reinforcement) portion 99 adjacent the front portion 13*a* of the first side panel 13, and a second (divider) portion 101 foldably connected to the reinforcement portion at an oblique fold line 103. The divider portion 101 includes a tab 105 at an oblique edge 107 of the divider flap 91. In one embodiment, the tab 105 is generally rectangular-shaped, but the tab could be otherwise shaped, arranged, and/or configured or omitted without departing from the disclosure.

With reference to FIGS. 2-7, in one exemplary method of erection, the carrier 5 may be erected from the blank 3 by positioning the front panel 11, the back panel 17, and the side panels 13, 23, 27 to form an interior 110 of the carrier 5. The blank 3 can be formed into a sleeve 205 having an open end 72, and the divider flap 91 can be positioned to at least partially divide the interior 110 of the carrier 5. The open end 72 can be closed after loading articles C into the open end.

Figure 3:
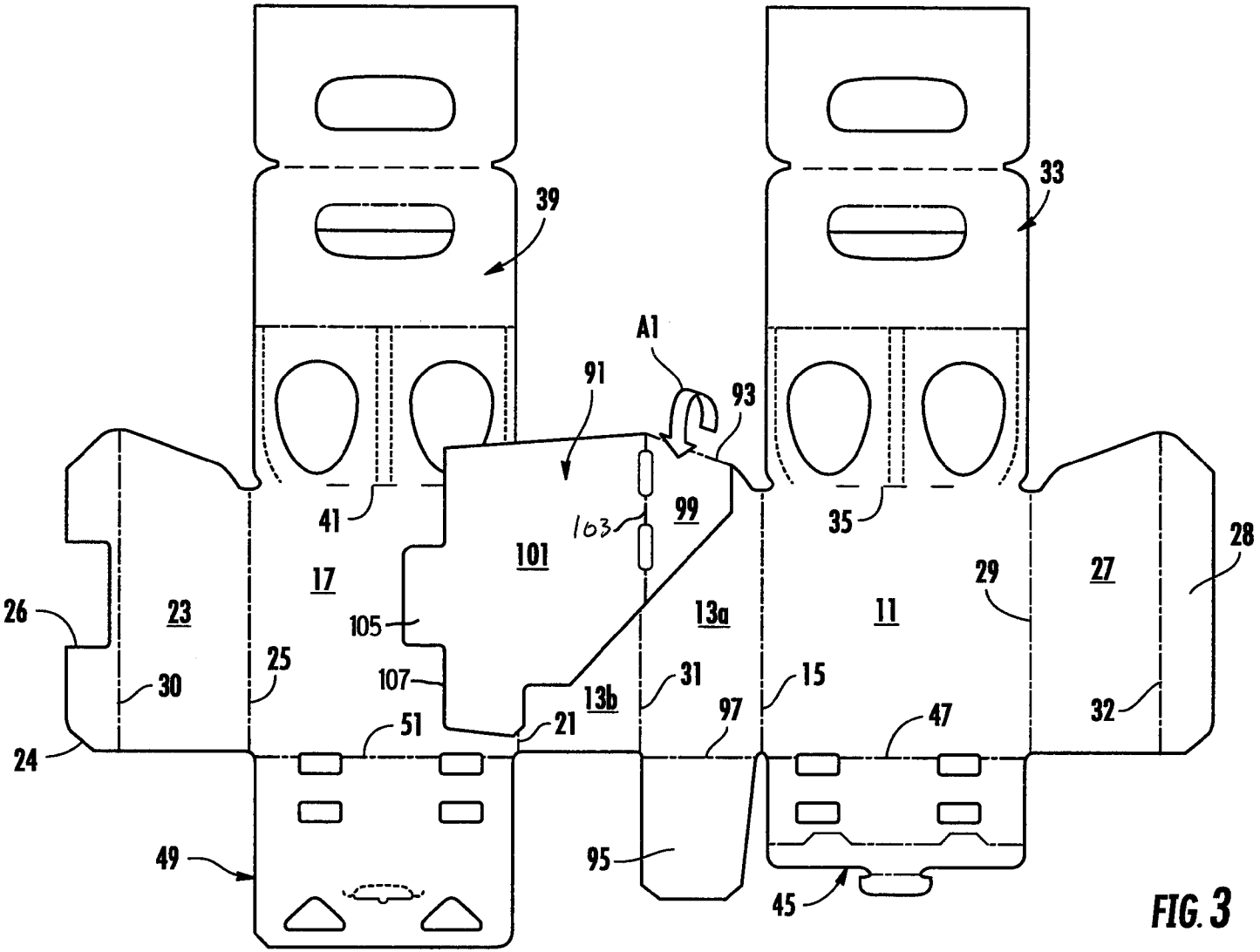
FIGS. 3-5 are views of the blank after folding about respective fold lines.
Figure 4:
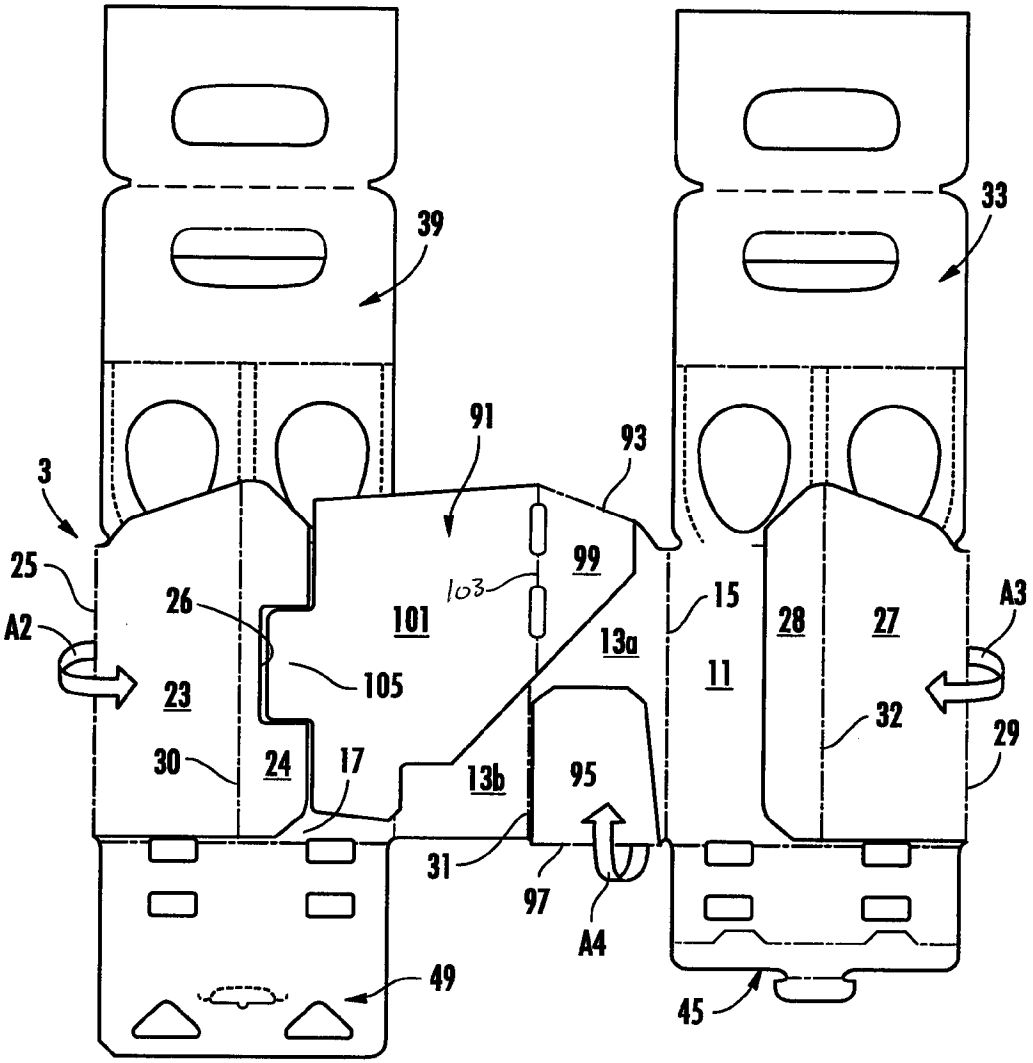
Figure 5:
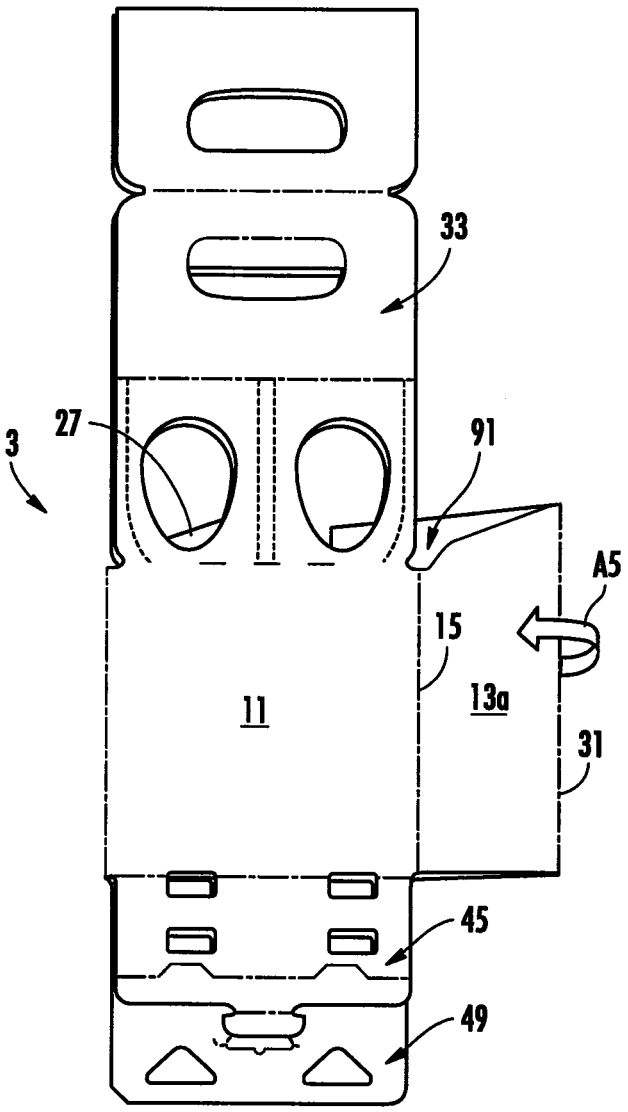

Particularly, in the exemplary method of erection, the carrier 5 may be erected from the blank 3 by respectively folding the divider flap 91 about the oblique fold line 93 in the direction of arrow A1 (FIG. 3) so that at least a portion of the divider flap is in face-to-face contact with the first side panel 13 and the back panel 17. As shown in FIG. 3, the reinforcement portion 99 of the divider flap 91 is in face-to-face contact with a portion of the front portion 13*a* of the first side panel 13, and portions of the divider portion 101 of the divider flap is in face-to-face contact with a portion of the rear portion 13*b* of the first side panel and a portion of the back panel 17. The second side panel 23 is folded in the direction of arrow A2 (FIG. 4) to be in face-to-face contact with a portion of the back panel 17. As shown in FIG. 4, the tab 105 of the divider flap 91 is shaped and sized to be received in the notch 26 of the second side panel 23. The second side panel 27 is folded in the direction of arrow A3 (FIG. 4) about fold line 29 to be in face-to-face contact with a portion of the front panel 11. The reinforcing flap 95 is folded in the direction of arrow A4 (FIG. 4) about fold line 97 to be in face-to-face contact with a portion of the first side panel 13. Adhesive can be applied to the blank 3 so that the reinforcement portion 99 of the divider flap and the reinforcing flap 95 are adhesively secured to the front portion 13*a* of the first side panel 13.

In one embodiment, adhesive can be applied to the adhesive flap 24, tab 105, and/or adhesive flap 28. The blank can be further assembled by folding in the direction of arrow A5 (FIG. 5) about fold line 31 dividing the two portions 13*a*, 13*b* of the first side panel 13. At this position, the adhesive flap 24, tab 105, and adhesive flap 28 are secured together. Also, the front panel 11 and back panel 17 are in an overlapping relationship, and the first top panel 33 and the second top panel are in an overlapping relationship. The first and second handle portions 57, 61 can be folded about a respective longitudinal fold line 63 to overlap and adhere the handle portions of each of the top panels 33, 39. From the position of FIG. 5, the first side panel 13 is folded about fold lines 15, 21, 31 to position the first and second portions 13*a*, 13*b* in a position generally perpendicular to the front and back panels 11, 17. The adhesively connected second and third side panels 23, 27 are folded about fold lines 25, 29, 30, 32 to position the second and third side panels in a position generally perpendicular to the front and back panels 11, 17. The top panels 33, 39 can be adhered together to partially close the top 70 of the carrier by adhering the second handle portion 61 of the first top panel 33 in face-to-face contact with the second handle portion 61 of the second top panel 39 (FIG. 8). Each of the first handle portions 75 can be adhered to the respectively attached second handle portion to further secure the handle portions together. The lower portions 52 can then extend at an oblique angle with respect to the front and back panels 11, 17 and the handle portions 57, 61 can extend in a generally vertical direction.

Figure 6:
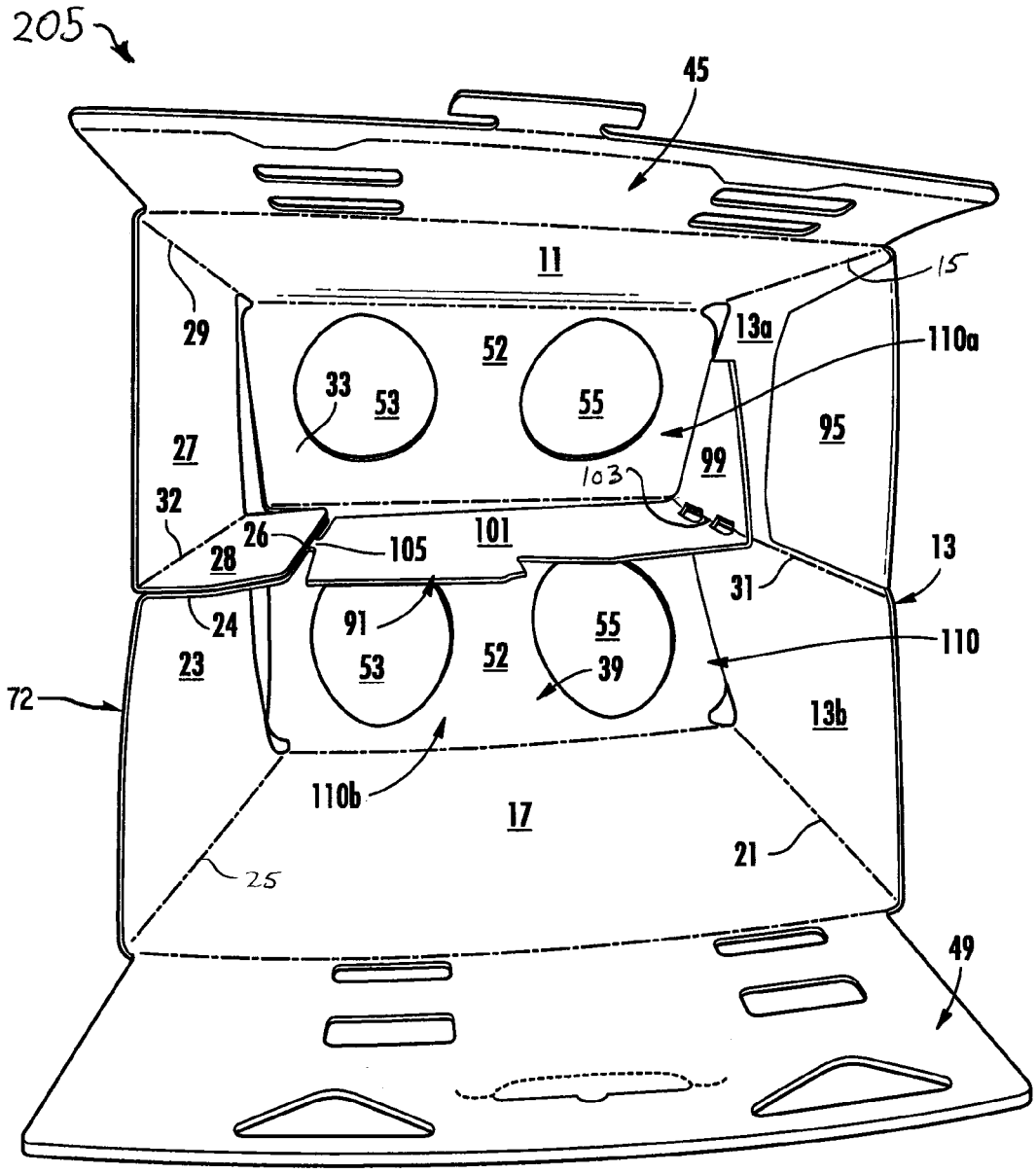
FIG. 6 is a bottom view of the partially-erected carrier formed from the blank of FIG. 1.

As shown in FIG. 6, the first side panel 13, the second and third side panels 23, 27, the front panel 11, and the back panel 17 define the sleeve 205 having an open bottom end 72. The sleeve 205 defines a generally interior square or rectangular interior space 110 for receiving containers in the carrier 5. The divider flap 91 forms a divider that extends across the interior 110 and is attached at one end to the first side panel 13 by the adhesive attachment of the reinforcement portion 99 to the front portion 13*a* of the first side panel. The divider 91 divides the space 110 into a front portion 110*a* and a back portion 110*b*. The other end of the divider 91 is attached to the adhesive flap 28 that is folded to be perpendicular to the third side panel 27. The adhesive flap 28 is secured to the adhesive flap 24 that is folded to be perpendicular to the second side panel 23. The divider or divider flap 91 could be otherwise shaped, arranged, and/or positioned such that the divider is attached to opposite sides of the carrier by other configurations.

Figure 7:
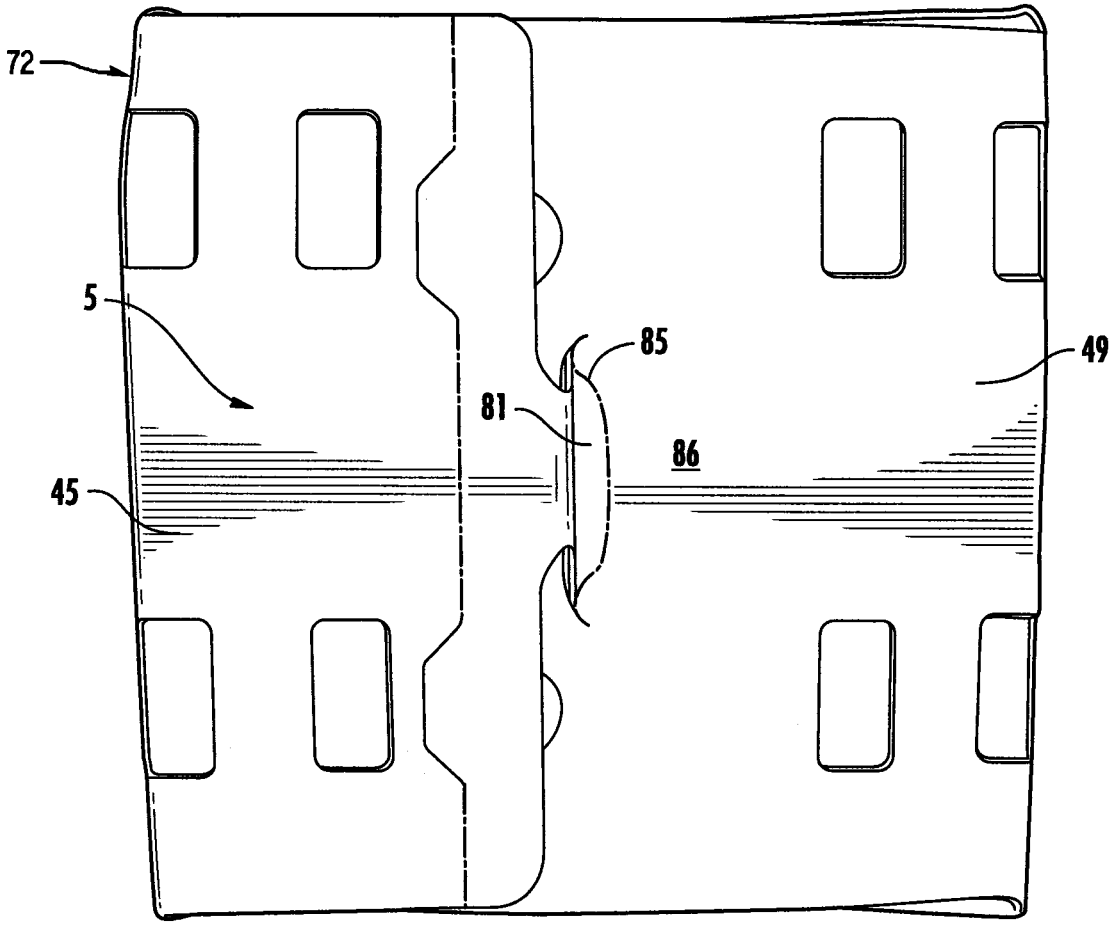
FIG. 7 is a bottom view of the carrier with the bottom panels closed.

In one embodiment, the containers C can be loaded from the open bottom end 72 of the sleeve 205 illustrated in FIG. 6. The upper portions P of the containers C can extend upward through the apertures 53, 55 in the lower portion 52 of the top panels. After the containers C have been loaded, the bottom panel 86 of the carrier 5 can be closed as illustrated in FIG. 7 by overlapping and interlocking the first and back bottom panels 45, 49 to close the bottom 72 of the carrier. The upper portions P of the containers C can push against the respective lower portion 52 of the top panels 33, 39, and the lines 68 can allow the lower portions 52 to bend in response to this pressure. The divider 91 is between each pair of containers C in the front portion 110*a* and second portion 110*b* of the container-receiving interior space 110 of the carrier 5. The divider 91 can be otherwise shaped, arranged and/or configured without departing from the disclosure.

Figure 9:
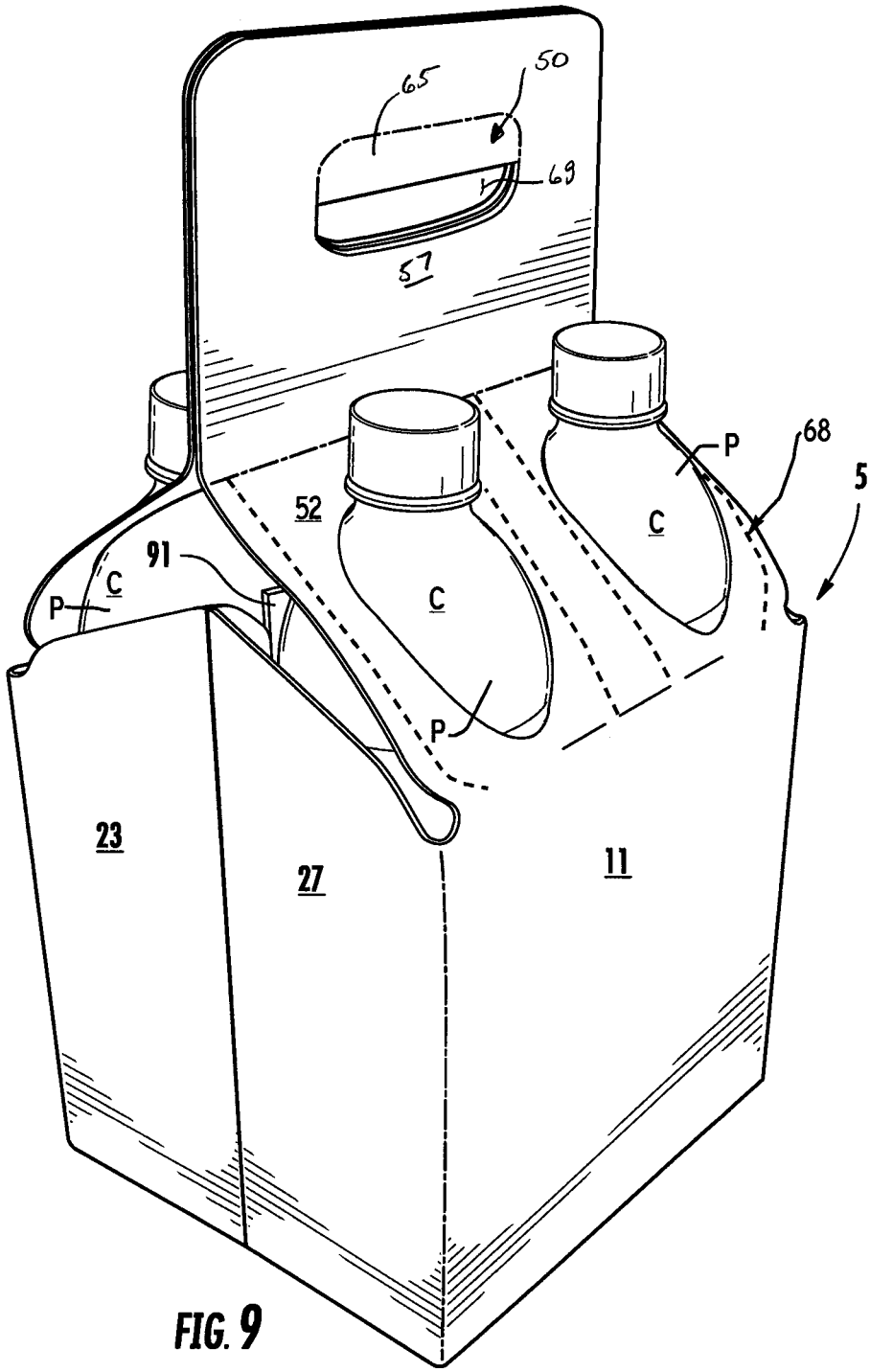

The erected carrier 5 shown in FIGS. 8 and 9 may be carried by pushing the handle flaps 65 from either side of the carrier so that the handle flaps are pushed through to the other side of the carrier to allow the carrier to be grasped at the handle 50. The carrier 5 could include dispensing features to assist in removal of the containers from the carrier without departing from the disclosure. The exemplary carrier embodiment discussed above accommodates four containers C arranged in two rows, but the present disclosure is not limited to these numbers. As one example, additional containers may be accommodated by increasing the size of the blank 3 (e.g., in the lateral direction L2 in FIG. 1) and forming additional container-receiving spaces therein. Also, the blank 3 could have less than two container-receiving spaces by having only one of the front panel 11 and back panel 17.

In one embodiment, the carrier 5 can accommodate containers C having a generally round upper rim, cap, or upper portion P and as having an exterior contour defined by generally circular horizontal cross-sections. To accommodate containers with a generally cylindrical and vertical upper portion P and other containers, the apertures 53, 55 can be generally ovoid-shaped, wherein the radius of curvature of the portion of the aperture near the lower edge of the top flaps 33, 39 is smaller than the radius of curvature of the aperture portion near the handle portions 57. Other types, sizes, and shapes of containers, however, can be accommodated by a carrier according to principles of the present disclosure.

In general, the blank may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carrier for containing a plurality of articles, the carrier comprises:

a front panel;

a back panel positioned opposite to the front panel;

at least one side panel foldably connected to at least one of the front and back panels;

at least one top panel foldably connected to one of the front panel and the back panel; and a divider flap foldably connected to the at least one side panel, the divider flap comprises a reinforcement portion foldably connected to the at least one side panel along a fold line and a divider portion foldably connected to the reinforcement portion, the reinforcement portion being at least partially in face-to-face contact with the at least one side panel.

2. The carrier of claim 1, wherein the fold line is an oblique fold line and the divider portion is foldably connected to the reinforcement portion at a generally vertical fold line.

3. The carrier of claim 2, wherein the oblique fold line coincides with a top edge of the at least one side panel.

4. The carrier of claim 2, the at least one side panel comprising a first side panel and a second side panel, wherein the divider flap is foldably connected to the first side panel, a first adhesive flap is foldably connected to the second side panel, and the divider portion comprises an adhesive tab that is adhered to the first adhesive flap.

5. The carrier of claim 4, wherein the divider portion is generally perpendicular to the first side panel and the first adhesive flap is generally perpendicular to the second side panel.

6. The carrier of claim 4, the at least one side panel further comprising a third side panel foldably connected to the back panel, wherein the second side panel is foldably connected to the front panel, and a second adhesive panel is foldably connected to the third side panel, the second adhesive panel being adhered to the first adhesive panel and comprising a notch, wherein the adhesive tab is at least partially received in the notch.

7. The carrier of claim 2, wherein the at least one side panel comprises a first side portion foldably connected to a second side portion and the reinforcement portion of the divider flap is foldably connected to the first side portion, and wherein a reinforcing flap foldably connected to the first side portion at a lower edge of the at least one side panel is in face-to-face contact with the first side portion.

8. The carrier of claim 1, the at least one top panel comprising a lower portion extending at an oblique angle from the front or back panel and a handle portion foldably connected to the lower portion, wherein the lower portion defines at least one aperture.

9. The carrier of claim 8, further comprising a reinforcing top flap foldably connected to the handle portion and in face-to-face contact with the handle portion.

10. The carrier of claim 9, the handle portion defining a first handle opening and the reinforcing top flap defining a second handle opening generally aligned with the first handle opening, wherein the handle portion is foldably connected to a handle flap adjacent to the first handle opening.

11. The carrier of claim 9, the at least one top panel comprising a first top panel foldably connected to the front panel and a second top panel foldably connected to the back panel, the reinforcing top flap of the first top panel is at least partially in face-to-face contact with the reinforcing top flap of the second top panel.

12. The carrier of claim 11, the handle portion and the reinforcing top flap of each of the first and second top panels extending generally vertically from the lower portion of the respective first and second top panels.

13. The carrier of claim 11 in combination with a plurality of articles at least partially contained within the carrier, wherein an upper portion of each article of the plurality of articles protrudes through a respective one of the at least one aperture in the first top panel and the at least one aperture in the second top panel.

14. The carrier of claim 1, further comprising a first bottom flap foldably connected to the front panel and a second bottom flap foldably connected to the back panel, the first and second bottom flaps cooperating to at least partially close the bottom of the carrier.

15. The carrier of claim 1 in combination with a plurality of articles at least partially contained within the carrier, wherein at least a portion of the divider flap forms a divider that extends across the interior of the carrier and divides the interior of the carrier into a front portion and a back portion, and wherein at least one of the articles is contained in the front portion and at least another one of the articles is contained in the back portion.

16. A blank for forming a carrier package, the blank comprising:

a front panel;

a back panel;

at least one side panel foldably connected to at least one of the front and back panels;

at least one top panel foldably connected to one of the front panel and the back panel; and a divider flap foldably connected to the at least one side panel, the divider flap comprises a reinforcement portion foldably connected to the at least one side panel along a fold line and a divider portion foldably connected to the reinforcement portion, wherein the reinforcement portion is for being disposed at least partially in face-to-face contact with the at least one side panel when the carrier package is formed from the blank.

17. The blank of claim 16, wherein the fold line is a first oblique fold line and the divider portion is foldably connected to the reinforcement portion at a second oblique fold line.

18. The blank of claim 17, wherein the first oblique fold line coincides with a top edge of the at least one side panel and the divider portion comprises an adhesive tab on an oblique edge of the divider portion.

19. The blank of claim 17, the at least one side panel comprising a first side panel and a second side panel, wherein the divider flap is foldably connected to the first side panel, a first adhesive flap is foldably connected to the second side panel, and the divider portion comprises an adhesive tab.

20. The blank of claim 19, the at least one side panel further comprising a third side panel foldably connected to the back panel, wherein the second side panel is foldably connected to the front panel, and a second adhesive panel is foldably connected to the third side panel, the second adhesive panel comprising a notch, wherein the adhesive tab is sized for being at least partially received in the notch.

21. The blank of claim 17, wherein the at least one side panel comprises a first side portion foldably connected to a second side portion and the reinforcement portion of the divider flap is foldably connected to the first side portion, and wherein a reinforcing flap is foldably connected to the first side portion at a lower edge of the at least one side panel.

22. The blank of claim 16, the at least one top panel comprising a lower portion and a handle portion foldably connected to the lower portion, wherein the lower portion defines at least one aperture.

23. The blank of claim 22, further comprising a reinforcing top flap foldably connected to the handle portion.

24. The blank of claim 23, the handle portion defining a first handle opening and the reinforcing top flap defining a second handle opening, wherein the handle portion is foldably connected to a handle flap adjacent to the first handle opening.

25. The blank of claim 16, further comprising a first bottom flap foldably connected to the front panel and a second bottom flap foldably connected to the back panel, the first and second bottom flaps being for at least partially closing the bottom of the carrier formed from the blank.

26. A method of assembling a carrier, the method comprising:

obtaining a blank comprising a front panel, a back panel, at least one side panel foldably connected to at least one of the front and back panels, at least one top panel foldably connected to one of the front panel and the back panel, and a divider flap foldably connected to the at least one side panel, the divider flap comprises a reinforcement portion foldably connected to the at least one side panel along a fold line and a divider portion foldably connected to the reinforcement portion;

positioning the front panel, the back panel, and the at least one side panel to form an interior of the carrier, the forming the interior of the carrier comprising forming a sleeve having at least one open end; and positioning the divider flap to at least partially divide the interior of the carrier, the positioning the divider flap comprising positioning the reinforcement portion at least partially in face-to-face contact with the at least one side panel.

27. The method of claim 26, wherein at least a portion of the divider panel is spaced apart from the front and back panels to divide the interior into a front portion and a back portion.

28. The method of claim 26, wherein the fold line is an oblique fold line and the divider portion is foldably connected to the reinforcement portion at a fold line, the positioning the divider flap comprises folding the divider portion to be generally perpendicular to the reinforcement portion.

29. The method of claim 28, the at least one side panel comprising a first side panel and a second side panel, wherein the divider flap is foldably connected to the first side panel, a first adhesive flap is foldably connected to the second side panel, and the divider portion comprises an adhesive tab, the positioning the divider flap comprises adhering the adhesive tab to the first adhesive flap.

30. The method of claim 26, further comprising inserting a plurality of articles into the at least one open end of the carrier, and positioning the at least one top panel to at least partially close the top of the carrier.

31. The method of claim 30, the at least one top panel comprises a first top panel foldably connected to the front panel and a second top panel foldably connected to the back panel, each of the first and second top panels comprising a plurality of apertures, wherein the inserting the plurality of articles comprises inserting an upper portion of each article into a respective aperture.

32. The method of claim 31, the positioning the at least one top panel to at least partially close a top of the carrier comprises bringing the first top panel into contact with the second top panel.

33. The method of claim 32, further comprising forming a handle by adhering a first handle portion of the first top panel to a second handle portion of the second top panel, wherein each of the first and second handle portions comprises a handle opening.

34. The method of claim 30, wherein the blank comprises at least one bottom panel and the method further comprises positioning the at least one bottom panel to close a bottom of the carrier after the inserting the plurality of articles into the interior of the carrier.

35. The method of claim 30, wherein the inserting a plurality of articles into the interior of the carrier comprises positioning at least one of the articles in a front portion of the interior of the carrier and positioning at least another one of the articles in a back portion of the interior of the carrier.

36. The carrier of claim 1, wherein the fold line coincides with a top edge of the at least one side panel.

37. The blank of claim 16, wherein the fold line coincides with a top edge of the at least one side panel.

* * * * *